United States Patent [19]

Mori et al.

[11] Patent Number: 4,696,689

[45] Date of Patent: Sep. 29, 1987

[54] METHOD AND APPARATUS FOR SEPARATING OF PRODUCT GAS FROM RAW GAS

[75] Inventors: Hideharu Mori; Shozi Koyama; Masahiro Yamazaki, all of Kudamatsu, Japan

[73] Assignee: Hitachi, Ltd., Tokyo, Japan

[21] Appl. No.: 803,675

[22] Filed: Dec. 2, 1985

[30] Foreign Application Priority Data

Nov. 30, 1984 [JP] Japan ..... 59-251822

[51] Int. Cl.[4] ..... F25J 3/02

[52] U.S. Cl. ..... 62/32; 62/36; 62/38; 62/42; 62/87

[58] Field of Search ..... 62/11, 32, 36, 38, 39, 62/42, 86, 87, 88

[56] References Cited

U.S. PATENT DOCUMENTS

| | | | |
|---|---|---|---|
| 3,492,828 | 2/1970 | Ruckborn | 62/38 |
| 3,696,637 | 10/1972 | Ness et al. | 62/88 |
| 3,756,035 | 9/1973 | Yearout | 62/39 |
| 3,989,478 | 11/1976 | Jones | 62/11 |
| 4,040,806 | 8/1977 | Kennedy | 62/39 |
| 4,072,023 | 2/1978 | Springmann | 62/39 |
| 4,222,756 | 9/1980 | Thorogood | 62/38 |
| 4,303,428 | 12/1981 | Vandenbussche | 62/38 |
| 4,539,816 | 9/1985 | Fox | 62/87 |
| 4,566,887 | 1/1986 | Openshaw | 62/39 |

*Primary Examiner*—Ronald C. Capossela

*Attorney, Agent, or Firm*—Antonelli, Terry & Wands

[57] ABSTRACT

A gas separating method and a gas separating apparatus according to the present invention effectively carry out the generation of the cryogenic effect within a plant for separating and extracting valuable gases such as nitrogen, oxygen, argon or the like from raw gas. For this purpose, the arrangement is such that low temperature gas within a process is subjected to a thermal exchange with the raw gas in a heat exchanger and is thermally restored; the thus restored gas is fed to a booster driven by an expansion turbine to be pressurized therein; the thus pressurized gas is cooled to the normal temperature by a cooler; the cooled gas is further cooled in the heat exchanger; and the still lower temperature gas is supplied to the expansion turbine to be adiabatically expanded, thereby generating the cryogenic effect.

28 Claims, 4 Drawing Figures

METHOD AND APPARATUS FOR SEPARATING OF PRODUCT GAS FROM RAW GAS

BACKGROUND OF THE INVENTION

1. Field of the Invention

The present invention relates to a gas separating method far of separating valuable gas components such as nitrogen, oxygen, argon or the like from raw gas so as to extract these components by a cryogenic process and is also concerned with a gas separating apparatus suitable for the above-described gas separating method.

2. Description of the Prior Art

There is broadly known a conventional method wherein offgas separated by means of a gas separating apparatus is introduced into a heat exchanger in which the offgas is subjected to a heat exchange with raw air in order to cool down the raw air and at the same time the offgas is made to flow in an expansion turbine, thereby generating a cryogenic effect. Namely, a cryogenic process which utilizes the above-described low temperature offgas has been disclosed in the specification of Japanese Patent Laid-Open No. 79972 in 1980. The method disclosed therein is such that the low temperature offgas discharged from a nitrogen condenser of an air separating apparatus is fed into a heat exchanger wherein the offgas is thermally restored to an intermediate temperature and is then made to flow in the expansion turbine so as to expand in an adiabatic manner, thereby generating the cryogenic effect; and the low temperature offgas employed for generating the cryogenic effect is again led into the heat exchanger for the purpose of returning it to the normal temperature. With this method, the low temperature offgas discharged from the air separating apparatus is transferred intact to the expansion turbine via the heat exchanger. The pressure at an inlet of the expansion turbine is determined by the pressure of the low temperature offgas which is released from the air separating apparatus so that the former never exceeds the latter. For this reason, there exists a limitation on the extent to which the cryogenic effect can be generated per unit processing gas quantity.

Inasmuch as the extent of the cryogenic effect generated per unit processing gas quantity is small, it is necessary to employ a large amount of gas in order to generate a corresponding cryogenic effect which the gas separating apparatus requires. In the case of, for instance, a plant which extracts nitrogen and oxygen from air serving as raw gas by effecting a separating operation, this plant necessitates a step wherein a great amount of air is pressurized and is then supplied to the plant. Such being the case, it is necessary to prepare a large booster for pressurizing a large amount of raw air; and as a result, the consumption in energy (electricity in ordinary cases) whereby the booster is driven increases. The large sized equipment and the increased consumption in energy disadvantageously boost the costs in production of product gases such as nitrogen, oxygen, argon or the like which are produced (extracted) by means of the gas separating apparatus.

SUMMARY OF THE INVENTION

Accordingly, it is a primary object of the present invention to provide a gas separating method and an apparatus pertaining thereto which are capable of augmenting the cryogenic effect generated per unit gas flow rate when low temperature gas within a process is utilized with a view to generating the cryogenic effect.

To this end, according to one aspect of the invention, there are provided a gas separating method and a gas separating apparatus which is small and of an energy-saving type.

According to another aspect of the invention, there are provided a gas separating method and a gas separating apparatus which are capable of extracting product gases at low cost.

A gas separating method according to the present invention comprises the steps of: thermally exchanging low temperature gas within a process with raw gas by means of a heat exchanger in order to restore the same gas in terms of temperature; causing the thermally restored gas to flow in a booster which is energized by an expansion turbine to pressurize the above-described gas; cooling down the thus pressurized gas to a low temperature; causing the gas cooled down to the low temperature to flow in the foregoing expansion turbine so as to expand such gas in an adiabetic manner; and generating a cryogenic effect.

Other objects and features of the present invention apart from the above will become evident from the following description with reference to the accompanying drawings.

DESCRIPTION OF THE PREFERRED EMBODIMENTS

The present invention will hereinafter be described in detail through the following embodiments thereof.

Figure 1:
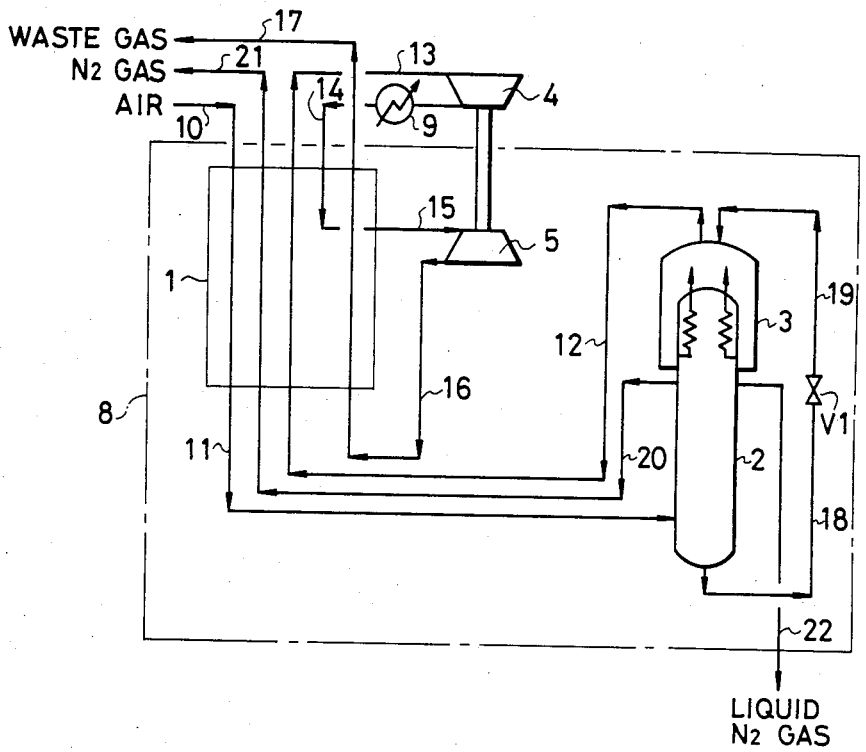
FIG. 1 is a flowchart illustrating one embodiment according to the present invention.

Referring now to FIG. 1, there is shown a system flowchart which illustrates a case where the present invention is applied to a plant designed for extracting nitrogen. Raw gas employed in the preferred embodiments according to the present invention involves air. The raw air is made to flow into a heat exchanger 1 via a conduit 10 at a pressure of approximately 8 kg/cm$^2$G. It is to be noted that moisture content and $CO_2$ which are contained in the raw gas are eliminated by means of a pre-treater (not illustrated). The raw air fed in the heat exchanger 1 is subjected to a thermal exchange with returning product nitrogen and low temperature offgas and is then cooled down to the saturation temperature, so that part of it is liquified and supplied via a conduit 11 to a fractionating tower 2. In the fractionating tower 2, the raw air is separated into product nitrogen and liquid air. The thus separated product nitrogen is drawn out from the upper portion of the fractionating tower 2 and is then led via a conduit 20 to the heat exchanger 1 wherein the product nitrogen is thermally returned to the normal temperature. Thereafter, the product nitrogen is sent outside the system through a conduit 21. The pressure at which the product nitrogen is transferred via the conduit 21 is 7 kg/cm$^2$G. The liquid air is drawn out from the lower portion of the fractionating tower 2 and passes through a conduit 18. The thus drawn-out liquid air is swollen up to a pressure of about 3 kg/cm$^2$G by use of a valve $V_1$and is then fed via a conduit 19 to a nitrogen condenser 3. In the nitrogen condenser 3, the ascending nitrogen in the fractionating tower 2 is liquified, while at the same time, the liquid air is gasified. The thus gasified low temperature offgas is drawn out through a conduit 12. The low temperature offgas transferred via the conduit 12 is restored to the normal temperature in the heat exchanger 1. Thereupon, such offgas flows via a conduit 13 in a booster 4 which is linked with an expansion turbine 5. The booster 4 carries out such a step that the energy equivalent to that of the cryogenic effect generated in the turbine 5 is imparted to the offgas as a result of increases in pressure and temperature. So far as the specification hereof is concerned, the booster involves a compressor, blower or the like which pressurizes gas. In this embodiment, the offgas on the output-side of the booster 4 is subjected to a pressure of 5 kg/cm$^2$G; and the temperature thereof ranges from 70° C. to 80° C. inclusive. The offgas forwarded from the booster is cooled down to the normal temperature in an after-cooler 9. A water-cooler, an air-cooler or the like can be employed as the after-cooler. The cooled offgas with a pressure of approximately 5 kg/cm$^2$G again enters the heat exchanger 1 via a conduit 14, where the offgas is further cooled to −120° C. Then, the offgas is drawn out through a conduit 15. The low temperature offgas sent via the conduit 15 flows in the expansion turbine 5 in which the offgas is adiabatically expanded up to a pressure of 0.3 kg/cm$^2$G, thereby to generate the cryogenic effect required for the apparatus. The offgas which has its temperature further lowered passes through a conduit 16 and enters the heat exchanger 1 wherein the thus cooled offgas is returned to the normal temperature. Thereafter, the offgas is discharged outside the system through a conduit 17. The product liquid nitrogen with a pressure of approximately 7 kg/cm$^2$G and also the saturation temperature is drawn out from the upper portion of the fractionating tower 2 and is then forwarded outside the system through a conduit 22. In the Figure, the reference numeral 8 stands for a low-temperature insulation tank.

According to this embodiment, the arrangement is not such that the low temperature offgas discharged from the nitrogen condenser 3 is made to directly flow in the expansion turbine, but such that the same offgas is made to flow therein after it has been pressurized by means of the booster. Consequently, it is possible that the pressure impressed on the offgas at the inlet of the expansion turbine exceeds the pressure applied to the offgas which is discharged from the nitrogen condenser. With respect to the expansion turbine, as the pressure at the inlet thereof increases, the pressure at the outlet thereof decreases, the cryogenic effect generated per unit gas flow rate is enlarged. Hence, a still greater amount of gelidity can be produced as compared with the prior art. With the gelidity increased, a stable operation can be realized, and concurrently, the amount of product liquid nitrogen to be extracted is increased. In case where a blower of the expansion turbine serves as the booster, the installation of a filter is unnecessary since the purified offgas is supplied to the blower. Furthermore, the blower eliminates the need for an air draw-out silencer, since the offgas never emanates in the atmosphere on the output-side of the blower. The constitution can therefore be simplified on the whole. Inasmuch as the offgas has virtually is or $CO_2$, corrosion of the blower of the expansion turbine is markedly reduced so that the lifetime thereof can be lengthened.

One embodiment of a plant suitable for extracting nitrogen is described above, however, the present invention is not confined thereto. The present invention has a wide variety of adoptability relative to plants necessary therefor; namely, a plant designed for extracted oxygen as well as a plant for extracting oxygen and nitrogen can, as a matter of course, be employed. Other plants are also usable. The gas to be employed for the cryogenic process may include not only offgas but also product gas or raw gas.

Figure 2:
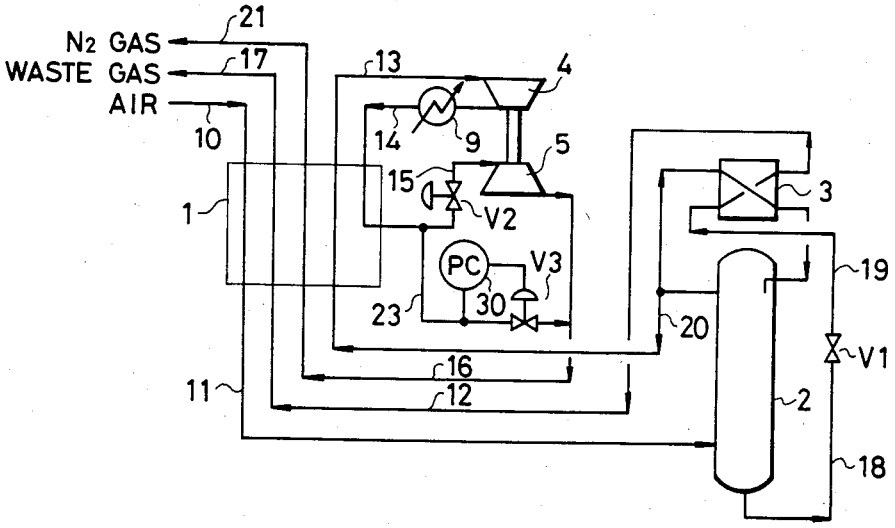
FIG. 2 is a flowchart illustrating another embodiment according to the present invention.

Referring to FIG. 2, there is described another embodiment according to the present invention. FIG. 2 is a system flowchart of a plant designed for extracting nitrogen from air by conducting a separating operation in the same manner as that shown in FIG. 1. A great difference between the embodiment shown in FIG. 1 and that in FIG. 2 is that nitrogen ($N_2$) defined as the product gas is utilized to generate the cryogenic effect when the low temperature gas within the process is to be employed for producing the cryogenic effect. That is, $N_2$ (product gas) with a pressure of some 2.2 kg/cm$^2$G which is drawn out via the conduit 20 from the fractionating tower 2 passes through a path provided within the heat exchanger 1 and is thermally restored to the normal temperature. Thereafter, the $N_2$ is transferred via a conduit 13 to the booster 4, where it is pressurized up to 3.5 kg/cm$^2$G. The $N_2$ which has risen in temperature due to the above-described pressurization is cooled down to the normal temperature by means of the after-cooler 9 and is then fed via a path constituted by a conduit 14 to the heat exchanger 1 wherein the $N_2$ gas is again cooled down to a still lower temperature (approximately −120° C.). The thus cooled $N_2$ is sent via a conduit 15 to the expansion turbine 5 wherein the $N_2$ is adiabatically expanded to a pressure of some 0.3 kg/cm$^2$G, whereby the cryogenic effect is generated. The thermally lowered $N_2$ is supplied via a conduit 16 to the heat exchanger 1 and passes through a path provided therein, thus returning to the normal temperature. The $N_2$ which has been thermally restored is fed via a conduit 21 to the destination of demand thereof. In the embodiment shown in FIG. 2, it can be seen that, if the cryogenic effect is greater than is required, a conduit 23 and valves $V_2$, $V_3$ which are combined into a bypass need to be provided therein with a view to preventing the plant as a whole from being unstable; and the pressure of the $N_2$ to be fed to the expansion turbine 5 is arranged to be controlled by means of a pressure controller (PC) 30.

According to the embodiment described in FIG. 2, the pressure of air serving as raw gas may be minimum, viz., 3 kg/cm$^2$G or thereabouts in ordinary cases, this minimum value being necessary for the fractionation thereof. In addition, the minimum pressure can lead to a saving in the energy required for pressurizing the raw air. The pressure controller provided with a bypass line makes it possible to operate in an extremely stable manner.

Figure 3:
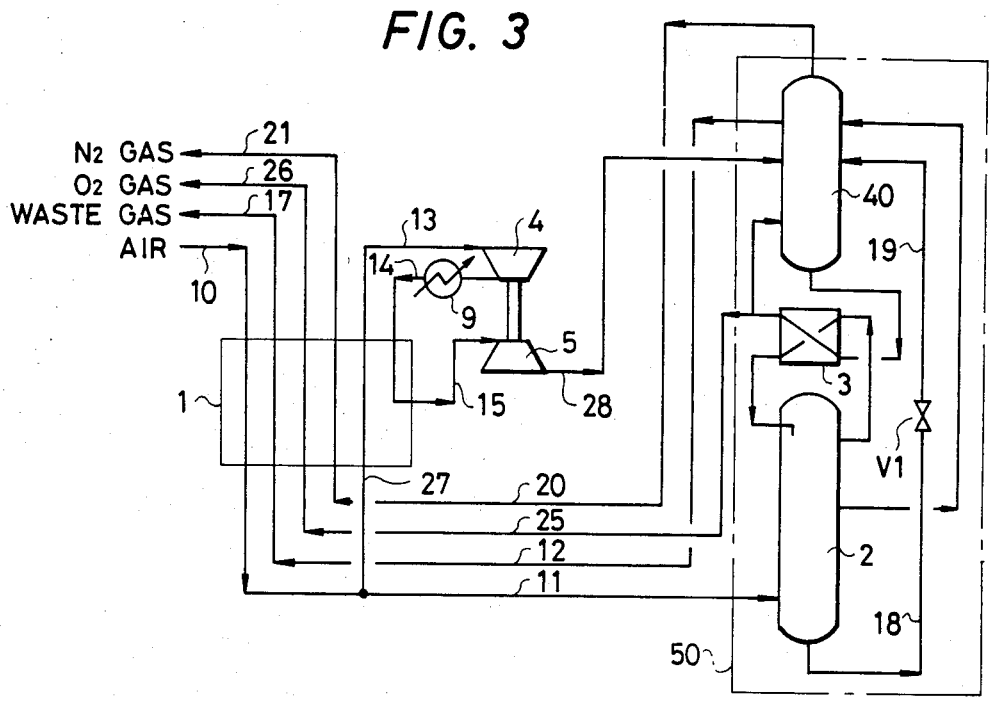
FIG. 3 is a flowchart illustrating still another embodiment according to the present invention.

Still another embodiment according to the present invention will hereinafter be described with reference to FIG. 3. FIG. 3 is a system flowchart of a plant designed for extracting nitrogen and oxygen from air by effecting a separating operation. The method adopted in the embodiment shown in FIG. 3 in much the same as those described in FIGS. 1, 2. The arrangement is therefore such that the low temperature gas within the process is made to become normal in temperature through the intermediary of the heat exchanger 1; the thermally normalized gas is pressurized by means of the booster 4 and is then cooled to the normal temperature by the after-cooler 9; the thus cooled gas is fed via a conduit 14 to the heat exchanger 1 wherein the gas is cooled to an even lower temperature; thereafter, the gas flows in the expansion turbine 5 through the conduit 15; and cryogenic effect can be generated adiabatically in the expansion turbine 5. However, an outstanding difference between the embodiment shown in FIG. 2 and that in FIG. 3 is such that a part of raw gas is transferred via a conduit 27 to the heat exchanger 1 wherein the gas is subjected to the thermal exchange and thus exchanged gas is then fed to the booster 4, the raw gas being utilized as the low temperature gas within the process to generate the cryogenic effect. The low temperature raw gas, after the cryogenic effect has been produced in the expansion turbine 5, is arranged to be supplied via a conduit 28 to a low-pressure tower (upper tower) of a duplex fractionating tower 50. The duplex fractionating tower 50 extracts nitrogen and oxygen from air defined as raw gas, each of which is drawn out through conduit 20, 25. Thereafter, the nitrogen and oxygen are thermally exchanged with the raw air in the heat exchanger 1 so as to be restored in terms of temperature; and the thus restored oxygen is fed via a conduit 26 to the destination of demand thereof. The nitrogen too is supplied via a conduit 21 to the destination of demand thereof. The fractionating processes within the duplex fractionating tower 50 are, however, broadly known, so that the detailed description relative thereto is herein omitted.

According to the embodiment shown in FIG. 3, a part of the raw air is fed out in order to be pressurized by means of the booster; and the pressurized raw air is utilized for generating the cryogenic effect, so that the amount of gelidity generated per unit gas flow rate is increased. Owing to this advantages, it is feasible to reduce the quantity of raw air needed for the generation of the cryogenic effect and the costs of power as well.

Figure 4:
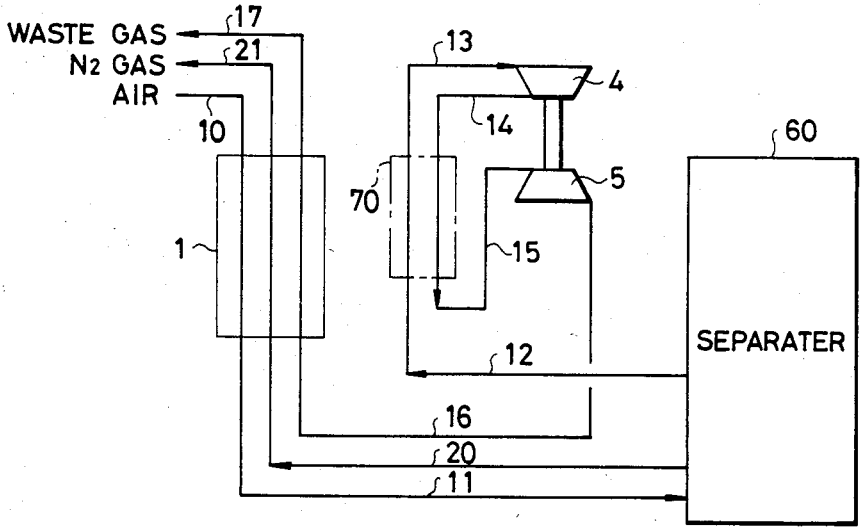
FIG. 4 is a flowchart illustrating a further embodiment according to the present invention.

With reference to FIG. 4, there is described in detail a further embodiment according to the present invention. The embodiment shown in FIG. 4 is fundamentally identical with those shown in FIGS. 1 to 3 inclusive. A modified arrangement with respect to the embodiment shown in FIG. 4, as compared with the previous embodiments, is not such that, when the low temperature gas within the process which has been discharged from a separator 60 is employed for the generation of the cryogenic effect, the gas, which has its temperature increased by the principal heat exchanger 1 is supplied to the booster 4, but such that the gas which is heightened in temperature by use of an auxiliary heat exchanger 70 otherwise provided is fed to the booster 4. Moreover, another different step must be added wherein the auxiliary heat exchanger 70 is employed to cool the gas, such gas being pressurized in advance by the booster 4.

Concerning the embodiment in FIG. 4, there is utilized the offgas which is used as the low temperature gas within the process to generate the cryogenic effect. It is, however, practicable to make use of product gas ($N_2$ or $O_2$) and raw gas defined as another low temperature gas within the process which is useful for the generator of gelidity. In such a case, the piping is carried out in the same way as those shown in FIGS. 2, 3 so that a description with a view pertaining thereto is omitted. As the separator 60, the fractionating tower shown in FIGS. 1 to 3 inclusive can be employed, which separator is not, however, confined thereto. An absorption type separator, for instance, may be adopted, such separator separating the gas with the aid of an absorbent such as zeolite or the like.

According to the present invention, as described above, it is possible to increase the amount of cryogenic effect generated per unit flow rate of low temperature gas by a cryogenic process wherein the low temperature gas within the process is utilized, this crucially contributing to the saving in energy and the miniaturization of the apparatus.

What is claimed is:

1. A gas separating apparatus comprising:

a heat exchanger for cooling raw gas by effecting a thermal exchange with returning low temperature gas;

a fractionating tower for taking in said raw gas cooled down by means of said heat exchanger, fractionally separating said raw gas into at least one product gas and an offgas and outputting said at least one product gas and said offgas, respectively;

an expansion turbine for taking in a low temperature gas within a process and subjecting said low temperature gas to adiabatic expansion for generating a cryogenic effect;

a path for leading normal temperature gas to a booster actuated by said expansion turbine after said low temperature gas has been restored to a normal temperature to form said normal temperature gas by means of said heat exchanger, said booster being capable of pressurizing said normal temperature gas;

a cooling means for cooling said gas pressurized by said booster to a much lower temperature; and a path for leading said gas cooled by said cooling means to said expansion turbine.

2. A gas separating apparatus as set forth in claim 1 wherein said low temperature gas is offgas separated in said fractionating tower.

3. A gas separating apparatus as set forth in claim 2, wherein there is provided a path for discharging said normal temperature offgas outside said process after said low temperature offgas has been returned to said normal temperature by means of said heat exchanger, said low temperature offgas being previously employed for generating said cryogenic effect with the aid of said expansion turbine.

4. A gas separating apparatus according to claim 2, wherein said returning low temperature gas is said offgas.

5. A gas separating apparatus as set forth in claim 1, wherein said low temperature gas is product gas separated in said fractionating tower.

6. A gas separating apparatus as set forth in claim 5, wherein there is provided a path for leading said normal temperature product gas to the destination of demand thereof after said low temperature product gas has been returned to said normal temperature by use of said heat exchanger, said low temperature product gas being previously employed for generating said cryogenic effect with the aid of said expansion turbine.

7. A gas separating apparatus according to claim 5, wherein said returning low temperature gas is said product gas.

8. A gas separating apparatus as set forth in claim 1, wherein said low temperature gas is a part of said raw gas cooled by means of said heat exchanger.

9. A gas separating apparatus as set forth in claim 8, wherein there is provided a path for leading said low temperature raw gas to said fractionating tower, said low temperature gas being previously employed for generating said cryogenic effect with the aid of said expansion turbine.

10. A gas separating method comprising:

pressurizing a raw gas to at least a pressure necessary for fractionation of said raw gas thereby generating a pressurized raw gas;

cooling said pressurized raw gas in a heat exchanger by heat exchanging said pressurized raw gas with returning low temperature gas thereby generating a cooled, pressurized raw gas;

introducing said cooled, pressurized raw gas into a fractionating tower wherein said cooled, pressurized raw gas is separated into at least one product gas and an offgas;

increasing the temperature of a low temperature gas thereby generating an increased temperature gas;

introducing said increased temperature gas into a booster driven by an expansion turbine wherein said increased temperature gas is pressurized thereby generating a pressurized gas;

cooling said pressurized gas thereby generating a cooled, pressurized gas; and introducing said cooled, pressurized gas into said expansion turbine wherein said cooled, pressurized gas is adiabatically expanded thereby generating gelidity.

11. A gas separating method according to claim 10, wherein said returning low temperature gas comprises at least one of said at least one product gas and said offgas.

12. A gas separating method according to claim 11, wherein said low temperature gas whose temperature is increased is said offgas.

13. A gas separating method according to claim 12, wherein after being adiabatically expanded, said cooled, pressurized gas is introduced into said heat exchanger wherein it is restored to normal temperature and thereafter discharged.

14. A gas separating method according to claim 12, wherein the step of increasing the temperature of said low temperature gas is performed in said heat exchanger through heat exchange with said pressurized raw gas and said pressurized raw gas is cooled in said heat exchanger by heat exchange with said returing low temperature gas.

15. A gas separating method according to claim 12, wherein the step of increasing the temperature of said low temperature gas and cooling said pressurized gas are performed in a second heat exchanger through heat exchange of said low temperature gas with said pressurized gas.

16. A gas separating method according to claim 11, wherein said low temperature gas whose temperature is increased is said at least one product gas.

17. A gas separating method according to claim 16, wherein after being adiabatically expanded, said cooled, pressurized gas is introduced into said heat exchanger wherein it is restored to normal temperature and thereafter discharged.

18. A gas separating method according to claim 16, wherein the step of increasing the temperature of said low temperature gas is performed in said heat exchanger and said pressurized gas is cooled in said heat exchanger.

19. A gas separating method according to claim 11, wherein said low temperature gas whose temperature is increased is a portion of said cooled, pressurized raw gas, and said portion of said cooled, pressurized gas is introduced into a low pressure section of a fractionating tower after it is adiabatically expanded.

20. A gas separating method according to claim 19, wherein the step of increasing the temperature of said low temperature gas is performed in said heat exchanger and said pressurized gas is cooled in said heat exchanger.

21. A gas separating method according to claim 11, wherein said returning low temperature gas is said low temperature gas, the temperature of which is being increased.

22. A gas separating method for separating a raw gas pressurized to above atmospheric pressure into product gas and offgas by introducing said raw gas into a fractionating tower after being cooled down in a heat exchanger with a returning low temperature gas, wherein a low temperature gas under said process is introduced, after being restored in terms of temperature to as high as normal room temperature, into a booster driven by an expansion turbine and pressurized therein, and said pressurized gas is then introduced, after being cooled down, into said expansion turbine to be adiabatically expanded therein so as to generate cold.

23. A gas separating method set forth in claim 22, wherein a low temperature gas from separation by said fractionating tower is restored in terms of temperature by heat exchanging with said raw gas before being cooled down by said heat exchanger, and said pressurized gas before being introduced into said expansion turbine is cooled down by heat exchanging with said returning low temperature gas.

24. A gas separating method as set forth in claim 22, wherein a low temperature gas from separation by said fractionating tower is restored in terms of temperature by heat exchanging with said raw gas before being cooled down by said heat exchanger and the pressurized gas from said booster, and said pressurized gas before being introduced into said expansion turbine is cooled down by heat exchanging with said returning low temperature gas and the gas before being pressurized.

25. A gas separating method as set forth in claim 22, wherein part of said raw gas after being cooled down in said heat exchanger and before being introduced into said fractionating tower is restored in terms of temperature by heat exchanging with said raw gas before being cooled down in said heat exchanger, and said pressurized gas before being introduced into said expansion turbine is cooled down by heat exchanging with said returning low temperature gas.

26. A gas separating method as set forth in claim 22, wherein said part of said raw gas after being cooled down in said heat exchanger and before being introduced into said fractionating tower is restored in terms of temperature by heat exchanging with said raw gas before being cooled down in said heat exchanger and the pressurized gas from said booster, and said pressurized gas before being introduced into said expansion turbine is cooled down by heat exchanging with said returning low temperature gas and the gas before being pressurized.

27. A gas separating method as set forth in claim 22, wherein a low temperature gas from separation by said fractionating tower is restored in terms of temperature by heat exchanging with the pressurized gas from said booster, and said pressurized gas before being introduced into said expansion turbine is cooled down by heat exchanging with the gas before being pressurized.

28. A gas separating method as set forth in claim 22, wherein part of said raw gas after being cooled down and before being introduced into said fractionating tower is restored in terms of temperature by heat exchanging with the pressurized gas from said booster, and said pressurized gas before being introduced into said expansion turbine is cooled down by heat exchanging with the gas before being pressurized.

* * * * *